United States Patent [19]

Cheng

[11] 4,028,262

[45] June 7, 1977

[54] CITRATE-CARBONATE BUILT DETERGENT

[75] Inventor: Bao-Ding Cheng, Highland Park, N.J.

[73] Assignee: Colgate-Palmolive Company, New York, N.Y.

[22] Filed: Jan. 24, 1975

[21] Appl. No.: 543,848

Related U.S. Application Data

[63] Continuation of Ser. No. 297,972, Oct. 16, 1972, abandoned.

[52] U.S. Cl. ..... 252/89 R; 252/135; 252/535; 252/528; 252/531; 252/525; 252/539; 252/540; 252/558; 252/559

[51] Int. Cl.[2] ..... C11D 7/34; C11D 3/34

[58] Field of Search ..... 252/89, 135, 525, 528, 252/531, 535, 539, 540, 558, 559

[56] References Cited

UNITED STATES PATENTS

| | | | |
|---|---|---|---|
| 3,714,074 | 1/1973 | Inamorazo | 252/528 |
| 3,749,675 | 7/1973 | Chang | 252/135 |
| 3,761,415 | 9/1973 | Gould | 252/89 |

*Primary Examiner*—Mayer Weinblatt
*Attorney, Agent, or Firm*—Herbert S. Sylvester; Murray M. Grill; Norman Blumenkopf

[57] ABSTRACT

Detergent compositions using only alkali metal citrate and carbonate builder salts are disclosed. The detergent compositions disclosed have a lower alkalinity than phosphate-free detergents employing high concentrations of silicates.

2 Claims, 3 Drawing Figures

CITRATE-CARBONATE BUILT DETERGENT

This is a continuation of application Ser. No. 297,972 filed Oct. 16, 1972, now abandoned.

BACKGROUND OF THE INVENTION

This invention relates to detergent compositions and, more particularly, to phosphate-free detergent compositions employing alkali metal carbonate and citrate builder salts.

Current detergent formulations contain large amounts of phosphate salts, primarily in the form of polyphosphates and orthophosphates. These phosphates have been found to be highly effective sequestering agents, but they are not without disadvantages. Phosphates and phosphate-containing detergent formulations have recently received considerable attention as prime suspects in water pollution. Phosphates are principally alleged to be causative in accelerated eutrophication of the nation's waters, and there has recently been an increasing demand for effective detergent compositions which are low in phosphates or, preferably free of phosphates.

Hard water contains an excess of $Ca^{+2}$ ions which interfere with the cleaning process. Phosphate ions are the most effective sequestrant currently in use in detergent formulations, but much effort is being directed toward reducing and eventually completely replacing phosphate salts in detergents. As the availability of other sequestrants is presently limited, it is no longer possible to have a high concentration of sequestrant in detergent formulations, and another method must be found for eliminating $Ca^{+2}$ ions from wash water.

Recently, attention has been directed to detergent formulations containing sodium carbonate to ameliorate the problem of washing in hard water. Where the detergent formulation contains mainly a surfactant and sodium carbonate, it is preferable to have the sodium carbonate acting as a water softener, and precipitation of the calcium ions is necessary. Where sodium carbonate is used primarily as a water softener in the laundry process, it is preferred to tie up $Ca^{+2}$ ions as soon as possible by interaction with the carbonate ions supplied by the sodium carbonate. Additionally, it is desirable to have good suspension of the resulting calcium carbonate precipitate in the wash water, in order to minimize adsorption of calcium carbonate onto fabric substrates and thus decrease fabric "boardiness".

At the present time the effect of calcium carbonate particles on the cleaning process is not well defined, but one can reasonably speculate that it is better for soil removal to maintain calcium carbonate particles in the bulk solution rather than to let them settle onto the dirt-fabric substrate.

The possible approaches for minimizing calcium carbonate adsorption are as follows:

a. retard calcium carbonate precipitation until after the wash cycle
b. delay calcium carbonate precipitation until the latter stages of the wash cycle
c. promote calcium carbonate suspension
d. enhance the efficiency of the rinse cycle
e. redesign the washing machine
f. use additives during the rinse cycle which can either redissolve calcium carbonate or remove calcium carbonate from fabric substrates The first two approaches are preferred because they best retain the original cleaning performance of the detergent. It is important to minimize calcium carbonate adsorption from sodium carbonate-containing detergent formulations.

It is generally agreed that the process of precipitation proceeds by two stages, beginning with nucleation onto impurity particles or seeds. Subsequently, the nuclei grow into visible crystallites. The crystallites may form a stable suspension or they may coagulate. When they become larger they tend to sediment.

The possible variables which can effect the interaction between the $Ca^{+2}$ ions and the carbonate ions are classified into two types, controllable and uncontrollable, based on the actual laundry conditions. Controllable variables include concentration of carbonate ions, surfactants and other detergent ingredients, the specific properties of the detergent ingredients, ionic strength, pH of the solution, and other crystallization variables such as inhibitors or promoters of precipitation. Uncontrollable variables include hardness of water, temperature, substrates (fabric, dirt and, impurities), and some other crystallization variables. There are some correlations among these variables, such as a minimum required hardness for a specific detergent formulation in order to have precipitation occur.

As the amount of sequestrant present in detergent formulations is gradually being reduced, it is of interest to determine the amount of a sequestrant needed for calcium control only in the laundry process to aid in formulating an effective detergent composition.

If a detergent system contains both sequestering and precipitating agents, the two anions will compete for the calcium ions as follows:

a. $Ca^{+2}$ + Sequestering anion $\rightleftharpoons$ Ca-Sequestrant Complex
b. $Ca^{+2}$ + Precipitating anion $\rightleftharpoons$ Ca-Precipitation Here, (a) process is generally much more rapid than (b) process. If the sequestrant is strong, (b) process will have little effect on (a) process, regardless of which are proceeds first. If the sequestrant is weak, there will be interference between the two processes. The final equilibrium of each process will depend on the order of occurrence and the amounts of agents used.

SUMMARY OF THE INVENTION

It has now been discovered that a combination of sodium citrate and sodium carbonate can be used to improve the cleaning performance of a nonionic-based detergent formulation. A concentration of from about 25 to about 5% sodium citrate and from about 30 to about 70% sodium carbonate is required to achieve an acceptable performance by this system.

An additional advantage for incorporating sodium citrate into sodium carbonate-built detergents is that calcium carbonate precipitates can be retarded during the normal wash cycle if an optimal weight ratio of sodium carbonate to sodium citrate is employed. It was found that this ratio is ideally equal to or less than 2 under washing conditions of water of 150 ppm. hardness at 40° C. The necessary ratio will decrease with increases in temperature and water hardness.

Because the dissolution rates of both sodium carbonate and sodium citrate into water are about the same, and also because it will usually take about one minute to induce calcium carbonate precipitation after the dissolution of sodium carbonate into water, it is not necessary to dissolve the sodium citrate into the water before dissolving the sodium carbonate in order to eliminate calcium carbonate precipitation. The calcium carbonate precipitation can be inhibited as long as a sufficient amount of sodium citrate is used, and it is dissolved into the water within one minute after the dissolution of the sodium carbonate.

A relatively lower level of sodium citrate, between about 5% and about 15% sodium citrate, was found to delay calcium carbonate precipitation until the later stage of the washing cycle and not to complete the precipitation during the washing cycle. It can also do much to improve the suspension of calcium carbonate which does precipitate (its particle size becomes fine and its surface charge increases). These functions will decrease the adsorption of calcium carbonate onto laundered fabric.

The citrate-carbonate-built detergents of the present invention have many advantages over currently known detergent compositions. Of primary importance is the absence of any phosphorus- or nitrogen-containing compounds which may possibly have adverse effects on the environment. Additionally, the silicate content of these detergent formulations is low, so that they have a lower alkalinity than conventional silicate-built detergents. This is of particular importance where children may be exposed to the detergents, as the highly caustic silicates may cause painful injury if touched with wet hands or swallowed. Also of great importance in hard water areas, the detergent compositions of the present invention prevent calcium carbonate precipitation on clothes in the wash cycle.

FIGS. 1A and 1B show the typical millivolt-time and turbidity-time curves of the two types of calcium control, i.e., precipitation and sequestration. (Millivolt is the electropotential of test solutions as determined by the calcium activity electrode. It can indicate concentration of free $Ca^{+2}$ ions in solution; the higher the negative value, the lower the ion concentration).

By using an optimal weight ratio of precipitating and sequestering agents in the detergent formulations, the millivolt time and turbidity-time curves would be like that in (a) + (b) in FIGS. 1A and 1B. This should theoretically be a favorable situation for laundering, because it would appear that the deleterious calcium ion was controlled right from the beginning of washing, which should be of benefit to detergency, and that calcium carbonate precipitation was retarded after the washing cycle or delayed until the later period of washing, which should decrease the adsorption of calcium carbonate onto fabric substrates.

The processes of calcium control and precipitation using a nonionic/citrate/carbonate detergent system functioned just like the above descriptions. Another important characteristic of this system is that sodium citrate behaves as a controlling agent for calcium ions in the precipitation process. It is apparent that the optimal ratio of the sodium citrate and the sodium carbonate will depend upon the sequestration capability of the sequestrant as well as the precipitation capability of a precipitating agent.

Where the detergent system contains both sequestering and precipitating agents, the two anions involved will compete for the calcium ions as follows:

a. $Ca^{+2}$ + Sequestering anion = Ca-Sequestrant Complex
b. $Ca^{+2}$ + Precipitating anion = Ca-Precipitation The final equilibrium of each process will depend upon the order of occurrence and the amounts of agents used.

A system containing 55% sodium carbonate and 33% sodium citrate was used to illustrate the above discussion. The salts were dissolved in hard water (125 ppm.) in all possible orders. The turbidities of these solutions were measured at 10 and 15 minutes, as shown in FIG. 2. The results are summarized below:

a. As long as reaction occurs between the $Ca^{+2}$ ions and the sodium citrate, sodium carbonate will have little effect on this interaction during the washing cycle.
b. As one minute is required to induce calcium carbonate precipitation, it is not necessary to predissolve sodium citrate in order to prevent precipitation of calcium carbonate.
c. During the precipitation of calcium carbonate, the addition of sodium citrate will have some effect, e.g., by decreasing the amount of calcium carbonate precipitation.
d. If calcium precipitation is complete, sodium citrate will have little effect on it, as sodium citrate is believed to be a weak calcium sequestrant.

The optimal weight ratio of sodium carbonate to sodium citrate in order to inhibit calcium carbonate precipitation during the washing cycle depends greatly upon water hardness and water temperature. The order of dissolution of these two salts makes very little difference under ordinary conditions. It was found that the ratio of sodium carbonate to sodium citrate must be equal to or less than 2 at 150 ppm. hardness and 40° C. The optimum ratio decreases with increases of temperature and hardness.

It is preferable to use a hardness insensitive surfactant in the detergent formulations of the present invention. Of particular value are the nonionic surfactants such as ethoxylated higher aliphatic alcohols, and the ethoxamer sulfates and in amounts of 5 to 30% by weight. Where use of an other anionic surfactant is desired, it is preferred to use a weight ratio of nonionic to anionic of one or more.

Nonionic surfactants suitable for use in the formulations of the present invention include those surface active or detergent compounds which contain an organic hydrophobic group and a hydrophilic group which is a reaction product of a solubilizing group such as carboxylate or hydroxyl with ethylene oxide or the polyhydration products thereof. Specific examples include the condensation products of alkyl phenols with ethylene oxide, e.g., the reaction product of isooctyl phenol with about six to about 30 ethylene oxide units; condensation products of higher fatty alcohols with six to 30 moles of ethylene oxide; ethylene oxide addends of monoesters of hexahydric alcohols and inner ethers thereof such as sorbitan monolaurate, sorbitol monooleate, and mannitol monopalmitate; and the condensation products of polypropylene glycol with ethylene oxide. Other nonionics include amine oxides, e.g., lauryl dimethyl amine oxide; sulfoxides and the like.

Suitable ethoxamer sulfates are prepared from aliphatic alcohols having between 8 and 13 carbon atoms; they have a predetermined number of ethylene oxide groups in order to obtain the desired physical properties and performance characteristics. In general, they have an average number of about 4 to about 10 moles of ethylene oxide per alkyl group, since the use of materials having a significantly different number of ethylene oxide groups does not result in the desired product. It is preferred to employ materials having an average number of from about 4 to about 6 moles of ethylene oxide, since their use results in optimum effects.

The ethoxamer sulfate material is commonly prepared by reaction of the appropriate higher alcohol with sufficient ethylene oxide followed by sulfation of the reaction product in known manner, such as by the use of oleum or chlorsulfonic acid.

Other suitable anionic surface active agents include those surface active or detergent compounds which contain an organic hydrophobic group and an anionic solubilizing group. Typical examples of anionic solubilizing groups are sulfonate, sulfate, carboxylate, phosphonate, and phosphate. As examples of suitable synthetic anionic detergents there may be cited, for example, the sodium salts of higher alkyl mononuclear aromatic sulfonates such as the higher alkyl mononuclear aromatic sulfonates such as the higher alkyl benzene sulfonates containing from 10 to 16 carbon atoms in the alkyl group in a straight or branched chain, the higher alkyl toluene, xylene, and phenol sulfonates; alkyl naphthalene sulfonate, ammonium diamyl naphthalene sulfonate, and sodium dinonyl naphthalene sulfonate.

other anionic surfactants are the olefin sulfonates, including long-chain alkene sulfonates, long-chain hydroxyl-alkane sulfonates or mixtures of alkenesulfonates and hydroxyalkanesulfonates. These olefin sulfonate detergents may be prepared, in known manner, by the reaction of $SO_3$ with long chain olefins (of 8–25, preferably 12–21 carbon atoms) of the formula R'CH=CHR'', where R' is alkyl and R'' is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g., sodium bisulfite), e.g., primary paraffin sulfonates of about 10–20, preferably about 15–20, carbon atoms; sulfates or higher alcohols; salts of $\alpha$-sulfofatty esters (e.g., of about 10–20 carbon atoms, such as methyl$\alpha$-sulfomyristate or $\alpha$-sulfotallowate).

Examples of sulfates of higher alcohols are sodium lauryl sulfate, sodium tallow alcohol sulfate, Turkey Red Oil or other sulfated oils, or sulfates or mono- or di-glycerides of fatty acids (e.g., stearic monoglyceride monosulfate), alkyl poly (ethenoxy) ether sulfates such as the sulfates of the condensation products of ethylene oxide and lauryl alcohol (usually having one to five ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having one to six oxyethylene groups per molecule).

The detergent compositions of the present invention may be formulated as liquids, solids, pastes, gels, etc. The compositions may be packaged in any suitable container or packaging material such as metal, plastic, or glass in the form of bottles, boxes, bags, cans, or drums. The detergents exhibit many desirable characteristics with regard to both physical properties and performance in use.

The detergent compositions of the present invention can be effectively used for laundering fabrics in water having a temperature of from about 60° to about 212° F., the detergents exhibiting unusually effective detergency characteristics in both cold and hot water. The concentration of the detergent in the water should range from about 0.05 percent to about 0.5 percent by total weight.

In washing fabrics, the addition of the fabrics and the detergent composition of the present invention can be conducted in any suitable conventional manner. Thus, for example, the fabrics can be added to the container or washer either before or after the washing solution is added. The fabrics are then agitated in the detergent solution for varied periods of time, a wash cycle of from five to fifteen minutes being generally used in the washing cycle of an automatic agitator type washer. After the fabrics are rinsed, they are dried, first by spinning and then by contact with air as in a conventional hanging of the fabrics of a clothesline or in an automatic dryer type system.

DESCRIPTION OF THE PREFERRED EMBODIMENTS

Figure 1A:
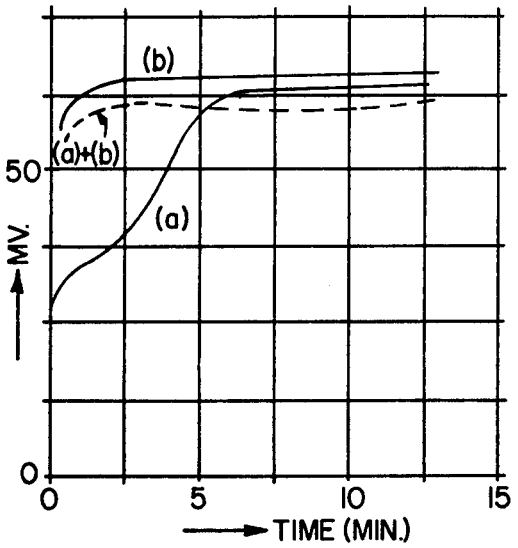
FIG. 1A shows the millivolt-time curves of precipitation and sequestration of $Ca^{+2}$ ions. Line (a) represents the precipitation mechanism (carbonate), and line (b) represents the sequestration mechanism (citrate).
Figure 1B:
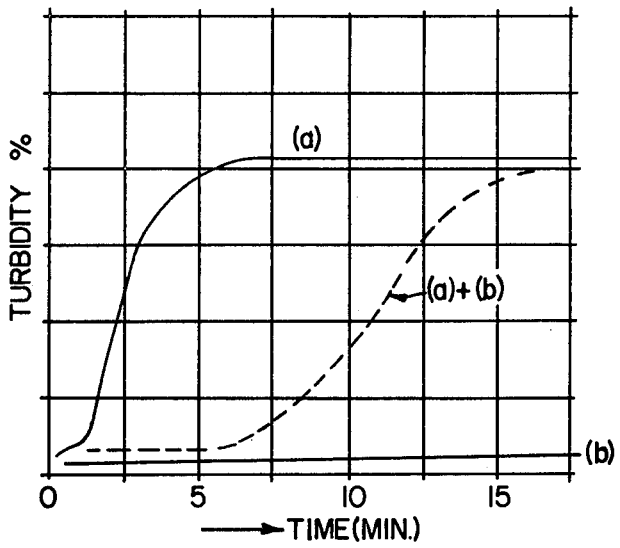
FIG. 1B shows the turbidity-time curves of precipitation and sequestration of $Ca^{+2}$ ions. Line (a) represents the precipitation mechanism (carbonate), and line (b) represents the sequestration mechanism (citrate).
Figure 2:
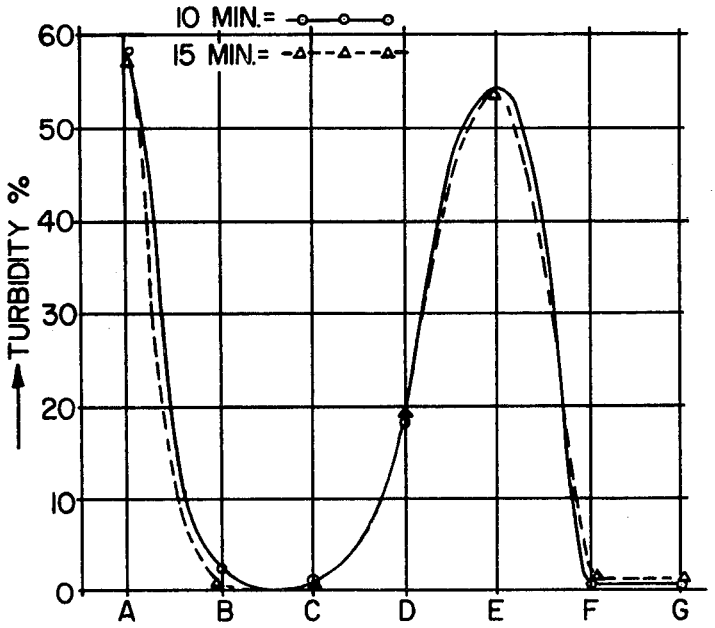
FIG. 2 shows turbidities of sodium citrate-sodium carbonate solutions in hard water. The original system is 55% sodium carbonate. Sodium carbonate and sodium citrate used in the systems designated (A) through (F) were predissolved in deionized water, and then mixed together for the study. In the system designated (G), the powder forms of sodium citrate and sodium carbonate were employed directly. At point (A), no citrate has been added. At (B), 55% sodium carbonate and 33% sodium citrate were added simultaneously. (C) shows a 33% sodium citrate solution one minute prior to adding sodium carbonate; (D) shows the solution 90 seconds after adding sodium carbonate. (E) shows the solution one hour after adding the sodium carbonate. (F) shows turbidity after titrating $Ca^{+2}$ and $Mg^{+2}$ into the sodium carbonate-sodium citrate system. At (G), a mixture of 55% sodium carbonate and 33% sodium citrate was added simultaneously. The final pH of the solutions was $10.5 \pm 0.1$.

The following specific examples illustrate various embodiments of the present invention. It is to be understood, however, that such examples are presented for purposes of illustration only, and the present invention is in no way to be deemed as limited thereby.

EXAMPLE I

A phosphate-free detergent was formulated from the following components:

| | Percent by Weight |
|---|---|
| Neodol 45-11* | 12 |
| Sodium carbonate | 55 |
| Sodium citrate | 20 |
| Sodium sulfate, water, brighteners | q.s. |

*$C_{14}$-$C_{15}$ alcohol ethoxylated with 11 moles of ethylene oxide

Three identical swatches of polyester/cotton fabric with permanent press finish were soiled with Piscataway particulate soil and washed in 500 mls. of a 0.15% solution of the above described detergent. The washing water used had a temperature of 120° F. and a hardness of about 150 ppm. The swatches were washed for 10 minutes, rinsed in 500 ml. tap water for five minutes, and dryer dried. The final whiteness or reflectance values, as measured on a Gardner Reflectometer, were 71.6, 71.9, and 71.4 Rd units, with the average reflectance being 71.6 Rd units.

EXAMPLE II

The addition of about 10% sodium silicate* to the detergent formulations of the present invention enhances their cleaning ability. This is not so much sodium silicate to make the composition hazardously alkaline.

A detergent was formulated as follows:

| | Percent by Weight |
|---|---|
| Neodol 45-11 | 12 |
| Sodium carbonate | 55 |
| Sodium citrate | 20 |
| Sodium silicate* | 10 |
| Sodium sulfate, water, brighteners | q.s. |

*The weight ratio of silica to sodium oxide in sodium silicate can be varied from 0.5 to 3.2. The preferential ratio in this invention is from 2.0 to 2.5.

Three identical swatches of polyester/cotton fabric were soiled with Piscataway particulate soil and washed in 500 mls. of a 0.15% solution of the above-described detergent. The washing water used had a temperature of 120° F. and a hardness of about 150 ppm. The swatches were washed for 10 minutes, rinsed in 500 ml. tap water for five minutes, and dryer dried. The final whiteness or reflectance values, as measured on a Gardner Reflectometer, were 73.5, 73.8, and 75.0 Rd units, with the average reflectance being 74.1 Rd units.

EXAMPLE III

Increasing the amount of sodium citrate in a citrate-carbonate built detergent only improves the cleaning power of the resulting detergent formulation to a small extent. However, it can effectively retard the $CaCO_3$ precipitation during the washing cycle.

A detergent was formulated as follows:

| | Percent by Weight |
|---|---|
| Neodol 45-11 | 12 |
| Sodium carbonate | 45 |
| Sodium citrate | 30 |
| Sodium silicate | 10 |
| Sodium sulfate, water, brighteners | q.s. |

Three identical swatches of polyester/cotton fabric were soiled with Piscataway particulate soil and washed in 500 mls. of a 0.15% solution of the above-described detergent. The washing water used had a temperature of 120° F. and a hardness of about 150 ppm. The swatches were washed for 10 minutes, rinsed in 500 ml. tap water (150 ppm. hardness) for 5 minutes, and dryer dried. The final whiteness or reflectance values, as measured on a Gardner Reflectometer, were 74.6, 75.8, and 76.4 Rd units, with the average reflectance being 75.6 Rd units.

EXAMPLE IV

A detergent was prepared from the following ingredients:

| | Percent by Weight |
|---|---|
| Neodol 45-11 | 12 |
| Sodium carbonate | 45 |
| Sodium silicate | 20 |
| Sodium citrate | 30 |
| Sodium sulfate, water, brighteners | q.s. |

EXAMPLE V

A detergent was formulated from the following ingredients:

| | Percent by Weight |
|---|---|
| Neodol 45-11 | 12 |
| Sodium carbonate | 45 |
| Sodium silicate | 20 |
| Sodium citrate | 10 |
| Sodium sulfate, water, brighteners | q.s. |

EXAMPLE VI

A detergent was formulated from the following ingredients:

| | Percent by Weight |
|---|---|
| Neodol 45-11 | 6 |
| Dodecyl benzene sulfonate | 6 |
| Sodium carbonate | 45 |
| Sodium silicate | 20 |
| Sodium citrate | 10 |
| Sodium sulfate, water, brighteners | q.s. |

EXAMPLE VII

A detergent was formulated from the following ingredients:

| | Percent by Weight |
|---|---|
| Neodol 45-11 | 6 |
| Dodecyl benzene sulfonate | 6 |
| Sodium carbonate | 45 |
| Sodium silicate | 10 |
| Sodium citrate | 30 |
| Sodium sulfate, water, brighteners | q.s. |

What is claimed is:

1. A phosphate-free nonionic-based detergent composition consisting essentially of, approximately by weight, 5 to 30% of a synthetic detergent selected from the group consisting of nonionic reaction products of 6 to 30 moles of ethylene oxide with higher fatty alcohols and 1:1 by weight mixtures thereof with dodecyl benzene sulfonate, 45 to 55% of sodium carbonate, and 10 to 33% of sodium citrate. the sodium carbonate and sodium citrate being correlated so that the weight ratio of sodium carbonate to sodium citrate is less than or equal to about 2 under washing conditions of water of 150ppm hardness and 40° C.

2. A detergent as in claim 1 further containing from about 5 to about 30% of sodium silicate having a weight ratio of silica to sodium oxide of 0.5 to 3.2.

* * * * *